US007677000B2

(12) United States Patent
Walker

(10) Patent No.: US 7,677,000 B2
(45) Date of Patent: Mar. 16, 2010

(54) POST SYSTEM FOR A RAILING

(75) Inventor: Simon Walker, Richmond (CA)

(73) Assignee: Peak Innovations Inc., Richmond (CA)

( * ) Notice: Subject to any disclaimer, the term of this patent is extended or adjusted under 35 U.S.C. 154(b) by 126 days.

(21) Appl. No.: 10/599,089

(22) PCT Filed: Mar. 30, 2005

(86) PCT No.: PCT/CA2005/000484

§ 371 (c)(1),
(2), (4) Date: Sep. 19, 2006

(87) PCT Pub. No.: WO2005/095737

PCT Pub. Date: Oct. 13, 2005

(65) Prior Publication Data

US 2007/0209316 A1 Sep. 13, 2007

(30) Foreign Application Priority Data

Apr. 1, 2004 (CA) ..... 2462360

(51) Int. Cl.
*E02D 27/32* (2006.01)

(52) U.S. Cl. ..... 52/296; 52/297; 248/519; 248/529; 248/539; 248/903; 248/910

(58) Field of Classification Search ..... 52/296, 52/297; 248/519, 529, 539, 903, 910, 346.5
See application file for complete search history.

(56) References Cited

U.S. PATENT DOCUMENTS

| | | | | |
|---|---|---|---|---|
| 1,090,171 | A | | 3/1914 | Schisler |
| 2,097,600 | A | | 11/1937 | Pavlecka |
| 2,277,587 | A | | 3/1942 | Gustafson |
| 2,756,999 | A | | 7/1956 | Orsatti |
| 3,083,951 | A | | 4/1963 | Huret |
| 3,166,299 | A | | 1/1965 | De Chellis |
| 3,267,627 | A | | 8/1966 | Hammitt |
| 3,415,475 | A | * | 12/1968 | Goodman ..... 248/158 |
| 3,420,504 | A | | 1/1969 | Mulitz |
| 3,463,456 | A | | 8/1969 | Walker |
| 3,484,081 | A | | 12/1969 | Rowan |
| 3,491,984 | A | | 1/1970 | Nyberg |

(Continued)

FOREIGN PATENT DOCUMENTS

| | | |
|---|---|---|
| CA | 1041337 | 10/1978 |

(Continued)

*Primary Examiner*—Richard E Chilcot, Jr.
*Assistant Examiner*—Mark R Wendell
(74) *Attorney, Agent, or Firm*—Mark Hopkinson

(57) ABSTRACT

A post system for a railing, the post system including a railing post, an insert and a post base. The railing post includes an elongated tubular body with first and second ends. The insert may snugly be insertable within the first end of the railing post. The post base may be connectable to the first end of the railing post and may have an inner member and an outer member substantially encasing the inner member. The inner member may be constructed from a first material, while the outer member may be constructed of a second material. The post base may include a base member and a housing member connected to and extending from the base member. The housing member may be adapted to engage the railing post.

33 Claims, 5 Drawing Sheets

U.S. PATENT DOCUMENTS

| | | | | |
|---|---|---|---|---|
| 3,633,862 | A | 1/1972 | Breen | |
| 3,875,699 | A | 4/1975 | Lamarre | |
| 3,918,686 | A | 11/1975 | Knott et al. | |
| 3,924,834 | A | 12/1975 | Young | |
| 3,955,800 | A | 5/1976 | Russo | |
| 3,957,250 | A | 5/1976 | Murphy | |
| 4,038,802 | A | 8/1977 | Bajorek et al. | |
| 4,050,828 | A | 9/1977 | Noro | |
| 4,269,534 | A | 5/1981 | Ryan | |
| 4,346,872 | A | 8/1982 | Tornya | |
| 4,381,160 | A | 4/1983 | Grimm et al. | |
| 4,429,497 | A | 2/1984 | Dibernardi | |
| 4,596,489 | A | 6/1986 | Mariol et al. | |
| 4,809,955 | A | 3/1989 | Veilleux | |
| 4,923,164 | A | 5/1990 | Stenberg | |
| D348,738 | S | 7/1994 | Jasinsky | |
| 5,375,384 | A * | 12/1994 | Wolfson | 52/295 |
| 5,568,909 | A | 10/1996 | Timko | |
| 5,713,171 | A | 2/1998 | Andres | |
| 5,852,895 | A | 12/1998 | Sinanan | |
| 6,003,826 | A | 12/1999 | Galloway, III | |
| 6,053,481 | A | 4/2000 | Scheide | |
| 6,061,991 | A | 5/2000 | Dahl | |
| 6,141,928 | A | 11/2000 | Platt | |
| 6,182,394 | B1 | 2/2001 | Bassler | |
| 6,213,452 | B1 | 4/2001 | Pettit et al. | |
| D443,937 | S | 6/2001 | Prokop | |
| 6,258,465 | B1 | 7/2001 | Oka et al. | |
| 6,282,861 | B1 | 9/2001 | Natelli, Jr. | |
| 6,336,620 | B1 | 1/2002 | Belli | |
| 6,446,930 | B1 * | 9/2002 | Li | 248/519 |
| 6,467,756 | B1 | 10/2002 | Elsasser | |
| 6,568,145 | B2 | 5/2003 | Bartel | |
| 6,640,517 | B2 | 11/2003 | Mitchell | |
| 6,702,259 | B2 | 3/2004 | Pratt | |
| 6,712,330 | B1 * | 3/2004 | Damiano | 248/519 |
| 6,718,710 | B2 * | 4/2004 | Platt | 52/296 |
| 6,735,916 | B2 | 5/2004 | Peshkam et al. | |
| 6,742,748 | B1 | 6/2004 | Gretz | |
| 6,863,253 | B2 * | 3/2005 | Valentz et al. | 248/519 |
| D503,813 | S | 4/2005 | Steffes et al. | |
| 6,988,700 | B2 | 1/2006 | Cote | |
| 7,155,867 | B2 * | 1/2007 | Saldarelli et al. | 52/292 |
| 7,188,821 | B2 * | 3/2007 | Curtis | 248/683 |
| 7,455,282 | B2 | 11/2008 | Platt | |
| 2002/0040956 | A1 * | 4/2002 | Carnahan et al. | 248/188.8 |
| 2003/0234391 | A1 | 12/2003 | Sheppard et al. | |
| 2006/0059812 | A1 * | 3/2006 | Simmons | 52/296 |
| 2007/0187564 | A1 * | 8/2007 | McGuire | 248/346.5 |
| 2008/0222973 | A1 | 9/2008 | Lee et al. | |

FOREIGN PATENT DOCUMENTS

| | | | |
|---|---|---|---|
| CA | 1055289 | | 5/1979 |
| CA | 1146393 | | 5/1983 |
| CA | 1178096 | | 11/1984 |
| CA | 1223472 | | 6/1987 |
| CA | 2274263 | A1 | 6/2000 |
| CA | 2277587 | | 7/2000 |
| CA | 2387296 | | 11/2002 |
| CA | 2218466 | A1 | 7/2006 |
| DE | 29607423 | | 6/1996 |
| EP | 0 984 118 | A2 | 3/2000 |
| GB | 1461802 | | 1/1977 |
| NZ | 242387 | | 5/1994 |
| WO | 91/13222 | | 9/1991 |
| WO | 03000022 | A2 | 1/2003 |
| WO | 2004090264 | A1 | 10/2004 |

* cited by examiner

POST SYSTEM FOR A RAILING

FIELD OF THE INVENTION

The invention relates to the field of railings and in particular to a post system for railings.

BACKGROUND OF THE INVENTION

Railings for any number of outdoor applications are well known. For example, residential decks, pool decks, playgrounds, etc., all utilize any number of conventional railings. Such railings are typically made of pressure treated lumber or aluminum particularly suited for outdoor use. Railings typically include hand and base rails attached to post supports. Post supports, in turn, attach to a deck surface or the like.

Building codes have been implemented in various jurisdictions throughout the world. Typically, in order to safeguard the public, these codes set out minimum performance requirements. One such requirement relates to railing posts. Here, posts are required to meet certain horizontal load requirements.

In the past, when such load requirements are applied to traditional posts, the posts have been known to fail by either deflecting more than what is allowable under code or by simply disengaging from a deck surface. Consequently, such posts are undesirable, particularly in the residential railing industry where homeowners frequently install or build their own railing systems.

Accordingly, a need exists for an improved post system for railings which overcomes the deficiencies noted above.

SUMMARY OF THE INVENTION

According to one aspect of the present invention there is provided a post system for a railing. The post system may include a railing post having first and second ends and a post base connectable to the first end of the railing post. The post base may include an inner member and an outer member substantially encasing the inner member. The inner member may be made from a first material while the outer member may be made from a second material. The first material may be steel while the second material may be aluminum.

The post system may further include fasteners for connecting the post base to said railing post. The fasteners may have dimensions of Ø8×80 mm.

According to another aspect of the present invention there is provided a post system for a railing. The post system may include a railing post having an elongated tubular body and first and second ends. The post system may include an insert snugly insertable within the first end of the railing post and include an engagement member to engage the elongated tubular body. The post system may further include a post base connectable to the first end of the railing post.

According to yet another embodiment of the present invention there is provided a post system for a railing. The post system may include a railing post having first and second ends and a post base connectable to the first end of the railing post. The post base may include a base member and a housing member connected to and extending from the base member. The housing member may be adapted to engage the railing post.

According to yet another embodiment of the present invention there is provided a post system for a railing. The post system may include a railing post having an elongated tubular body and first and second ends and an insert snugly insertable within the first end of said railing post. The insert may include an engagement member to engage the elongated tubular body. The post system may further include a post base having an inner member and an outer member substantially encasing the inner member. The inner member may be made from a first material and the outer member may be made from a second material. The post base may be connectable to the first end of the railing post and may include a base member and a housing member connected to and extending from the base member. The housing member may be adapted to engage the railing post.

Other aspects of the invention will be appreciated by reference to the detailed description of the preferred embodiment and to the claims that follow.

BRIEF DESCRIPTION OF THE DRAWINGS

The preferred embodiment of the invention will be described by reference to the drawings thereof in which.

DESCRIPTION OF THE PREFERRED EMBODIMENT OF THE INVENTION

Figure 1:
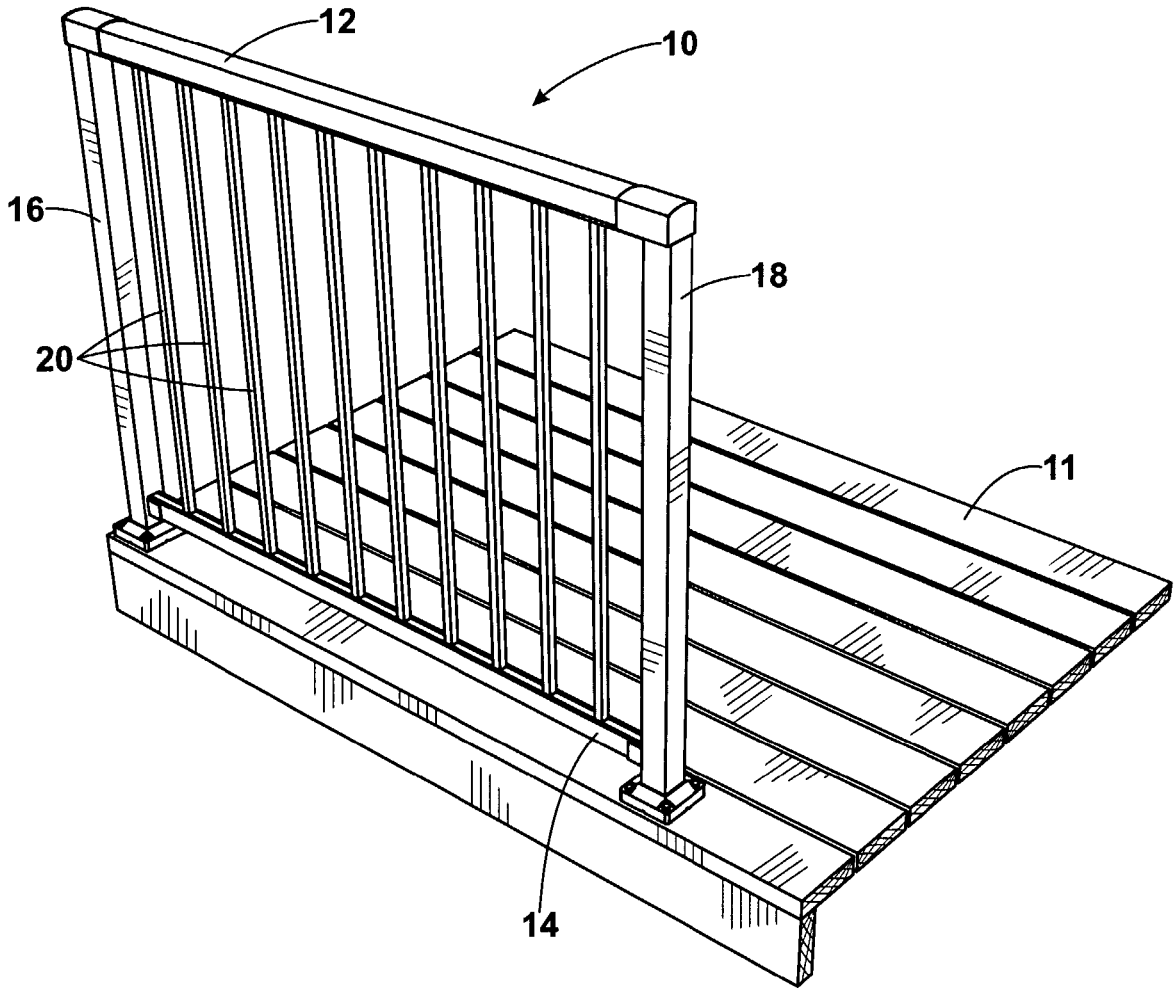
FIG. 1 is a perspective view of a railing attached to a deck surface incorporating a post system in accordance with a first embodiment of the present invention.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a third embodiment. It is intended that the present invention include such modifications and variations as come within the scope and spirit of the present invention.

Referring to FIG. 1, a railing 10 is generally shown attached to a deck surface 11. Railing 10 includes top and bottom rails 12 and 14, end posts 16 and 18 and pickets 20.

Figure 2:
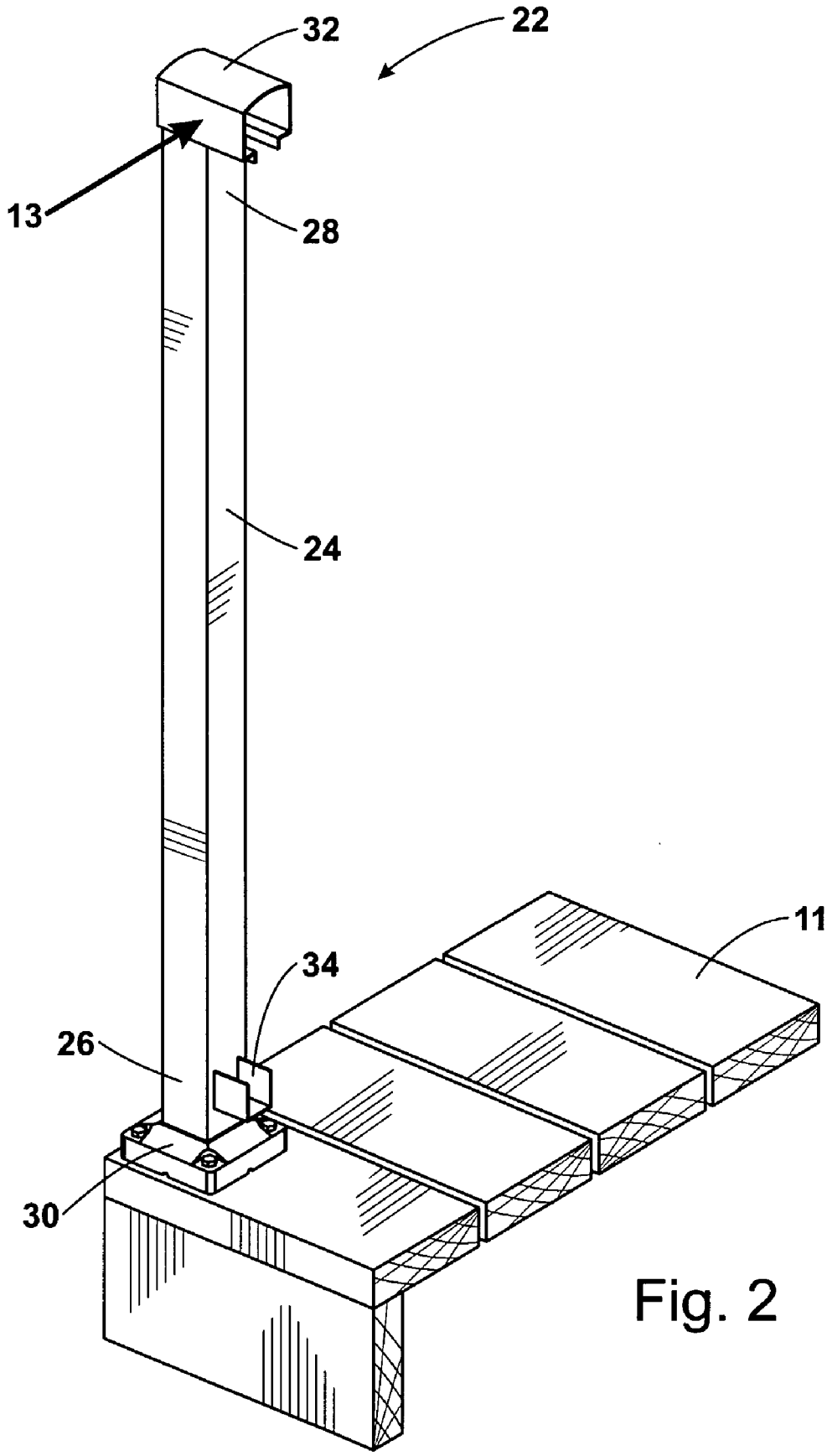
FIG. 2 is a perspective view of a representative post system of the railing of FIG. 1.

FIG. 2 illustrates a representative post system 22 attached to a deck surface 11. Post system 22 includes a railing post 24 having first and second ends 26 and 28 and a post base 30 connectable to the first end of the railing post. To determine whether a post system meets local building code requirements, a horizontal load along line 13 is generally applied to the post system.

Generally, to meet certain building codes, railing post 24 must meet a minimum load requirement before it can bend or fail. When a horizontal load is applied along line 13 forces are directly transferred from railing post 24 to post base 30. Therefore, certain building codes require that post base 30 remain attached to deck surface 11 when a horizontal load is applied to railing post 24. The effect of a horizontal load on a railing post and consequentially on a post base is discussed in further detail below.

Figure 3:
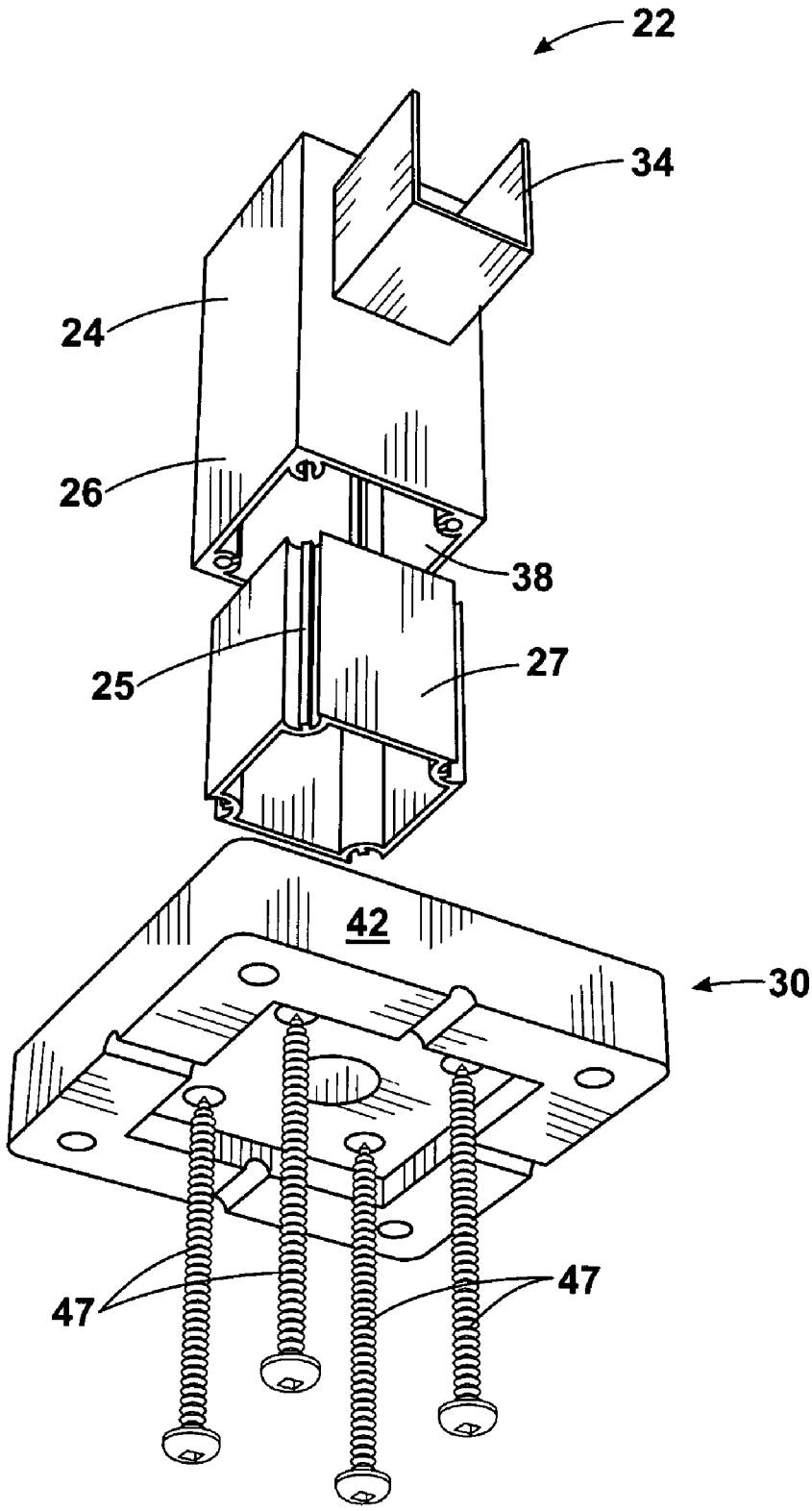
FIG. 3 is a perspective exploded view of the representative post system of FIG. 2 as shown from below depicting a portion of a railing post.

Referring to FIGS. 2 and 3, railing post 24 is generally an elongated tubular body with an inner wall 38. As those skilled in the art will appreciate, the cross sectional shape of railing post 24 may be square as depicted in FIG. 3 or any other suitable shape, for example, a circle. Second end 28 includes an open ended head 32 shaped to receive top rail 12. Railing post 24 may also include a base rail support 34 to receive the bottom rail 14.

Preferably, open ended head 32 and base rail support 34 are shaped to snugly fit top and bottom rails 12 and 14 to secure the top and bottom rails to railing post 24. As those skilled in the art will appreciate, other methods may be used to further secure the top and bottom rails 12 and 14 to railing post 24, such as fasteners.

Figure 5:
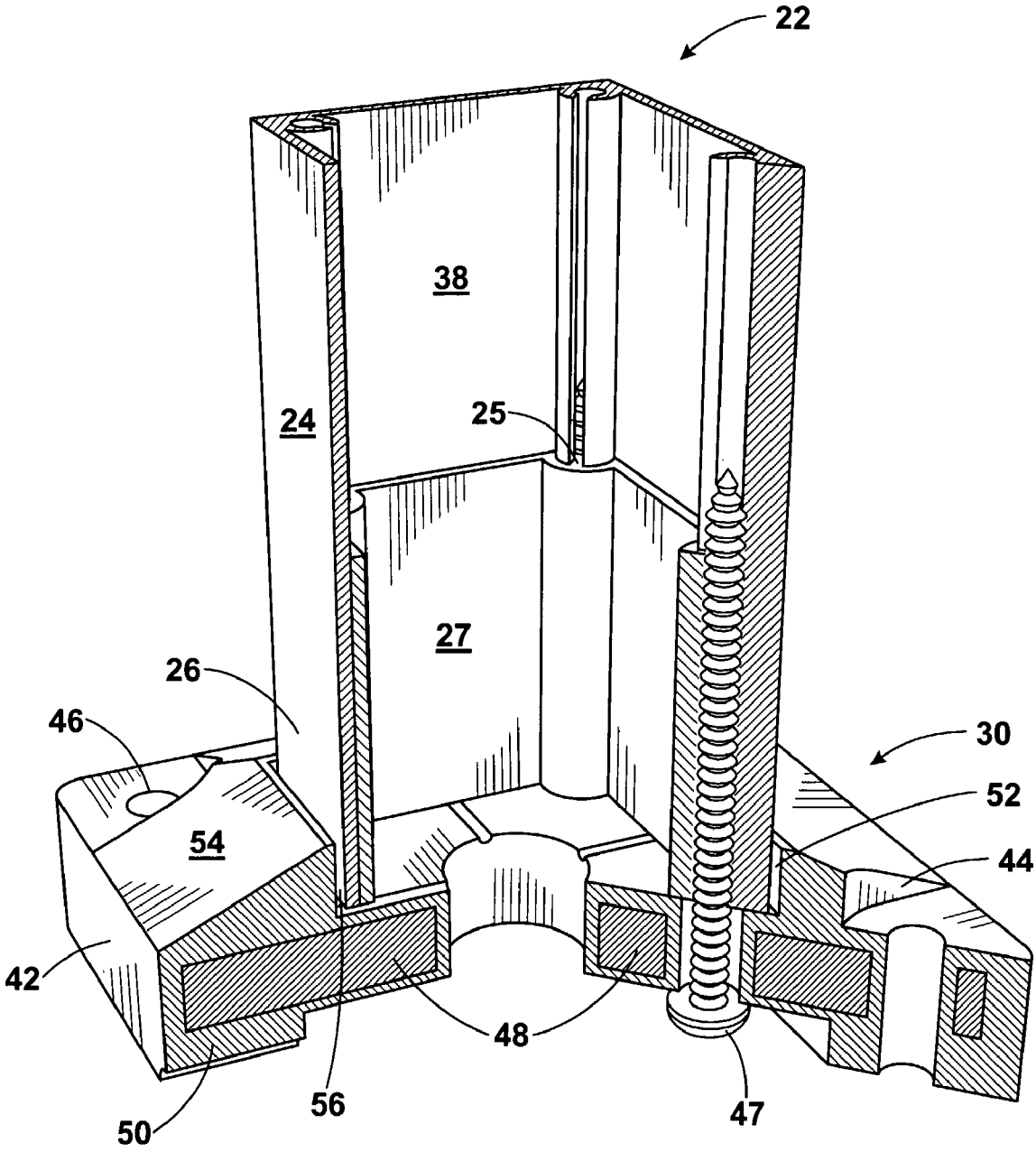
FIG. 5 is a cutaway view of the post system of FIG. 2 depicting a portion of a railing post.

Referring to FIGS. 3 and 5, to provide rigidity to the railing post 24, an insert 27 is snugly insertable within first end 26 of the railing post. Insert 27 is shaped to frictionally engage inner wall 38 of railing post 24. Insert 27 may include an engagement member 25 which may aid in securing the insert to railing post 24. Engagement member 25 may be connected to insert 27 via welding for instance. Preferably, engagement member is integrally formed with insert 27. As those skilled in the art will appreciate, the length of the insert as well as material of construction may be any length or substance, respectively, suitable to reinforce the railing post and may vary depending on local building codes. Depending upon local building codes, post base 30 may be connected to first end 26 of railing post 24; in other instances, post rail 24 and insert 27 may simply be attached directly to a surface without the need for a post base.

Figure 4:
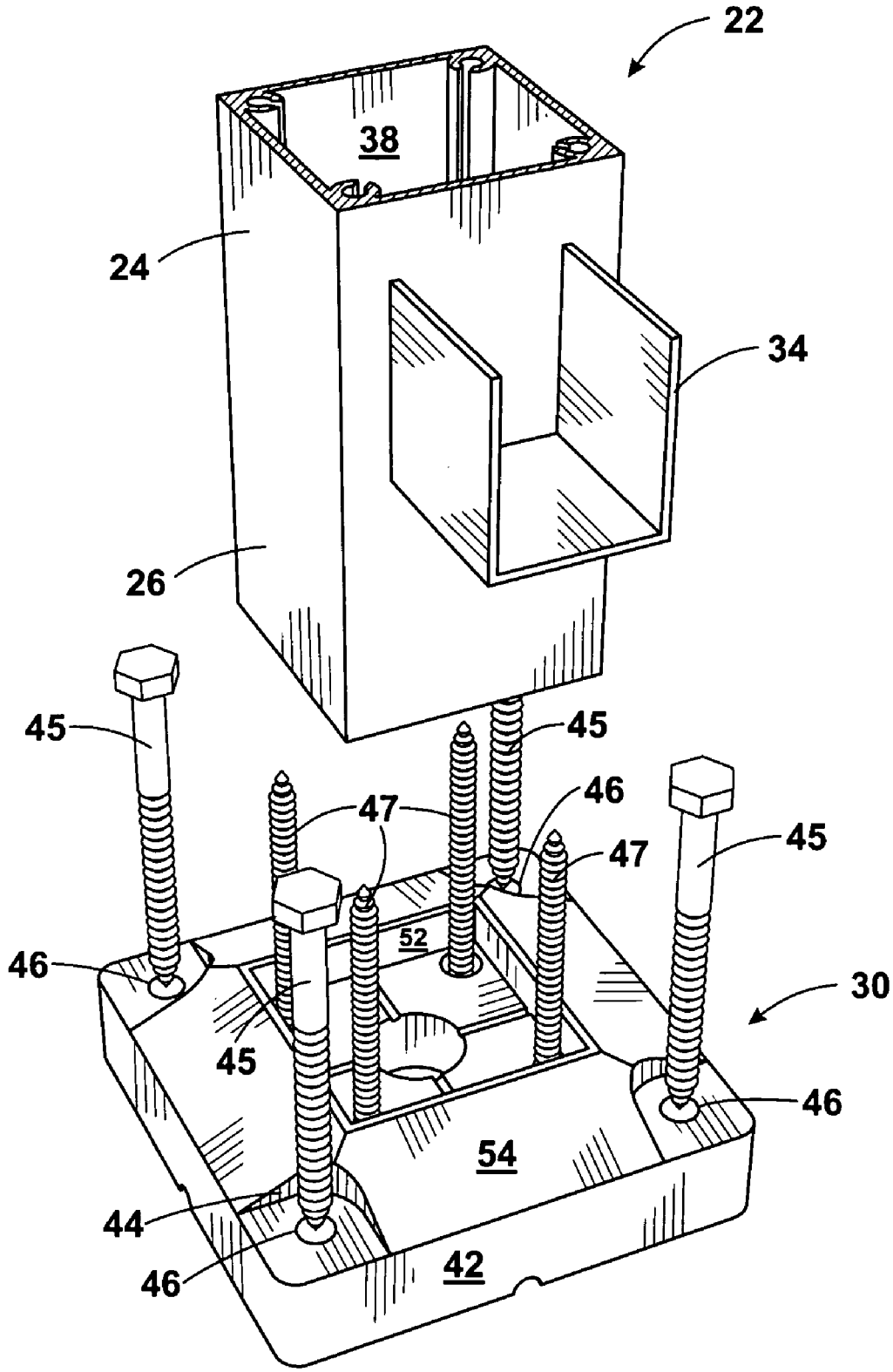
FIG. 4 is a perspective view of a post base of a representative post system of FIG. 2 along with a portion of a railing post.

Referring to FIGS. 4 and 5, post system 22 includes a post base 30 connectable to railing post 24. Post base 30 includes a base member 42 and a housing member 44 connected to and extending from the member. Housing member 44 may be connected to base member 42 via welding or adhesives. Preferably, housing member 44 and base member 42 are integrally formed. Base member 42 includes holes 46 whereby fasteners 45 may be inserted to attach post system 22 to a surface. Fasteners 47 with a dimension of Ø8×80 may used to connect post base 30 to railing post 24. Additionally, post base 30 may be connected to railing post 24 via welding or adhesives.

As illustrated in FIG. 5, post base 30 includes an inner member 48 and an outer member 50 substantially encasing the inner member. With traditional post systems a post base is generally constructed from a single material, for example, aluminum or steel. An aluminum post base is light weight, however, does not provide the necessary strength to meet certain horizontal load requirements. On the other hand, a steel post base is strong enough to meet certain horizontal load requirements, but is prone to rusting in inclement weather.

Therefore, to take advantage of the properties from various materials, post base 30 is constructed of two differing materials. In this embodiment, inner member 48 is constructed from a first material, for example, steel, and outer member 50 is constructed from a second material, for example, aluminum.

Housing member 44 rises up from base member 42 and is adapted to engage the railing post 24. Housing member 44 includes an inner wall 52 and an outer wall 54. Typically, traditional post systems employ a housing which snugly fits around a railing post. These systems fail to meet certain local building codes as horizontal loads, when applied to a railing post, are directly transferred to the inner wall of a housing of a post base. The direct transfer of force from the railing post to a post base causes the post base to detach from a surface.

To overcome the above problem, a circumferential gap 56 exists between the inner wall 52 and railing post 24 when the railing post is connected to the post base 30. This gap is created by forming a housing member that is dimensioned larger than the railing post. When a horizontal load is applied to railing post 24, no forces are transferred to inner wall 52 until the railing post bends to meet the inner wall. Thus, railing post 24 would have to bend well-before any forces are transferred to post base 30. As those skilled in the art will appreciate, depending on local building code requirements, the amount of separation or gap required between a railing post and the inner wall of the housing may be of any size suitable to meet code.

As local building codes vary from jurisdiction to jurisdiction, post system 22 may include any combination of the above elements. For example, a post system may simply include a railing post connectable to a post base. The post base may have an inner member and an outer member, both of which are constructed of two differing material. When additional rigidity is required for the railing post, an insert may simply be inserted into the railing post. To enhance the connection of the post base to a surface a circumferential gap may exist between a railing post and post base. As those skilled in the art will appreciate, local building codes may dictate any combination of the above.

It should be appreciated by those skilled in the art that various modifications and variations can be made in the present invention without departing from the scope or spirit of the invention. It is intended that the present invention include such modifications and variations as come within the scope of the appended claims and their equivalents.

What is claimed is:

1. A post system for a railing, the post system comprising:

a railing post comprising an elongated tubular body having first and second ends;

an insert snugly insertable within said first end of said railing post to engage an interior face of the railing post;

a post base connectable to said first end of said railing post, said post base comprising a housing portion configured to snugly engage said railing post, said post base comprising an inner structural member made of a first material completely encased within a surface member made of a second material different than the first material, the inner structural member having top and bottom surfaces and apertures extending through the inner structural member between the top and bottom surfaces, the surface member having portions extending through the apertures, the post base having a top surface, a bottom surface and a plurality of bores extending between the top and bottom surfaces of the post base through the portions of the surface member, the bores completely lined by the second material of the surface member, wherein said insert comprises one or more engagement members for engaging the interior face of the railing post, each engagement member comprising a projection received in a corresponding channel in the interior face of the railing post.

2. The post system of claim 1 comprising one or more fasteners, each fastener extending through a corresponding one of the bores for connecting said post base to said railing post.

3. The post system of claim 1, the top surface of said post base comprising a plurality of horizontal flat surfaces, at least one of said bores intersecting each of said horizontal flat surfaces for receiving a deck fastener capable of securing the post base to a deck surface.

4. The post system of claim 3, the top surface of said post base further comprising an outer wall top surface that is sloped to distribute water away from said railing post, said outer wall top surface adjacent to said horizontal flat surfaces.

5. A post base for supporting a first end of a railing post, the post base comprising:

an inner structural member made of a first material completely encased within a surface member made of a second material different than the first material, the inner structural member having top and bottom surfaces and apertures extending through the inner structural member between the top and bottom surfaces, the surface member having portions extending through the apertures, the post base having a top surface, a bottom surface and a plurality of bores extending between the top and bottom surfaces of the post base through the portions of the surface member, the bores completely lined by the second material of the surface member wherein the bottom surface of the post base comprises one or more coplanar horizontal flat bottom surface portions, each of the horizontal flat bottom surface portions intersected substantially perpendicularly by at least one of the bores wherein a central recessed portion of the bottom surface of the post base is recessed relative to the one or more horizontal flat bottom surface portions.

6. A post base according to claim 5 wherein the top surface of the post base comprises a plurality of horizontal flat top surface portions, each of the horizontal flat top surface portions intersected substantially perpendicularly by at least one of the bores.

7. A post base according to claim 5 wherein one or more of the plurality of bores is located in a central region of the post base and extends between the top surface of the post base and the central recessed portion.

8. A post base according to claim 5 wherein the bottom surface of the post base comprises one or more channels extending between the central recessed portion and an outer periphery of the post base.

9. A post base according to claim 6, wherein the plurality of horizontal flat top surface portions comprises four horizontal flat top surface portions located at four corresponding corners of the top surface of the post base.

10. A post base according to claim 5 wherein the top surface of the post base comprises a top surface central recess dimensioned to receive an end of the railing post to be supported by the post base.

11. A post base according to claim 10 wherein the top surface of the post base comprises an outer wall top surface portion located around at least a portion of the perimeter of the top surface central recess wherein the outer wall top surface portion is sloped outwardly away from the top surface central recess to distribute water away from said railing post.

12. A post base for supporting a first end of a railing post, the post base comprising:

a member having top and bottom surfaces and apertures extending through the member between the top and bottom surfaces, the top surface configured to receive one end of a railing post;

the bottom surface of the post base comprising a horizontal planar outer portion surrounding a central recessed portion.

13. A post base according to claim 12 further comprising one or more channels, each channel extending through the planar outer portion from the central recessed portion to an outer periphery of the post base.

14. A post base according to claim 13 comprising a plurality of bores for receiving fasteners capable of securing the post base to the post, the plurality of bores extending between the bottom surface and a postreceiving portion of the top surface.

15. A post base according to claim 14 wherein the plurality of bores extend between the central recessed portion of the bottom surface and the postreceiving portion of the top surface.

16. A post base according to claim 14, the top surface comprising one or more horizontal flat surfaces, at least one of the apertures intersecting each of the horizontal flat surfaces for receiving a fastener capable of securing the post base to a deck surface.

17. A post base according to claim 16, the top surface comprising a housing portion configured to receive and engage the post.

18. A post base according to claim 16, the top surface comprising a housing portion having an inner wall and an outer wall, the housing portion configured to receive the post within the inner wall.

19. A post base according to claim 18, the inner wall being dimensioned to provide a circumferential gap between the inner wall and the post when the post is connected to the post base.

20. A post base according to claim 18, the outer wall top surface being sloped to distribute water away from the post, the outer wall top surface adjacent to the horizontal flat surfaces.

21. A post base according to claim 20, the apertures comprising a drainage aperture extending through the post base between the housing portion and the central recessed portion of the bottom surface.

22. A post base according to claim 21 further comprising:

an inner structural member made of a first structural material completely encased within a surface member made of a second structural material different from the first structural material;

the inner structural member having top and bottom surfaces, the apertures and the bores extending through the inner structural member between the top and bottom surfaces; and the apertures and the bores being completely lined by the second structural material of the surface member.

23. A post base according to claim 22 wherein the first structural material is a metallic material.

24. A post base according to claim 23 wherein the first structural material is steel.

25. A post base according to claim 23 wherein the second structural material is a corrosion-resistant structural material.

26. A post base according to claim 24 wherein the second structural material is aluminum.

27. A post system for a railing, the post system comprising:

a railing post comprising an elongated tubular body having first and second ends and a plurality of channels in walls of the railing post for engaging fasteners;

a post base connectable to the first end of the railing post, the post base comprising a housing portion adapted to receive and snugly engage the railing post;

the post base having a top surface, a bottom surface and a plurality of bores extending between the top and bottom surfaces of the post base, the bores including bores that are aligned with the channels when the railing post is engaged in the housing portion.

28. A post system according to claim 27 wherein the bottom surface of the post base comprises a planar outer portion surrounding a central recessed portion and one or more channels, each channel extending through the planar outer portion between the central recessed portion and an outer periphery of the post base.

29. A post system according to claim 27 wherein the top surface of the post base comprises an outer wall top surface portion located around at least a portion of the railing post wherein the outer wall top surface portion is sloped outwardly away from the railing post to distribute water away from the railing post.

30. A post system according to claim 27 wherein the top surface of the post base comprises a plurality of flat top surface portions, each of the flat top surface portions intersected substantially perpendicularly by at least one of the bores.

31. A post base according to claim 30, wherein the plurality of horizontal flat top surface portions comprises four horizontal flat top surface portions located at four corresponding corners of the top surface of the post base.

32. A post base according to claim 27 wherein the bottom surface of the post base comprises one or more channels extending between a central recessed portion of the bottom surface and an outer periphery of the post base.

33. A post system according to claim 27 comprising a plurality of fasteners, the fasteners each insertable through a corresponding one of the bores and engageable with one of the channels to connect the post base to the railing post.

* * * * *